US005699707A

United States Patent [19]

Campbell, Jr.

[11] Patent Number: 5,699,707

[45] Date of Patent: Dec. 23, 1997

[54] HIGH SPEED SHEET MATERIAL CUTTER AND METHOD OF USING SAME

[75] Inventor: Robert L. Campbell, Jr., Hickory, N.C.

[73] Assignee: Automated Solutions, LLC, Hickory, N.C.

[21] Appl. No.: 381,739

[22] Filed: Feb. 1, 1995

[51] Int. Cl.[6] ..... B26D 7/20

[52] U.S. Cl. ..... 83/100; 83/152; 83/431; 83/938; 198/689.1; 198/811

[58] Field of Search ..... 83/100, 152, 451, 83/938, 155.1, 374; 198/689.1, 811

[56] References Cited

U.S. PATENT DOCUMENTS

| | | | |
|---|---|---|---|
| 2,790,464 | 4/1957 | Stephens et al. | 83/155.1 |
| 3,495,492 | 2/1970 | Gerber et al. . | |
| 3,592,334 | 7/1971 | Fleischauer | 198/811 |
| 3,682,750 | 8/1972 | Gerber . | |
| 3,776,072 | 12/1973 | Gerber et al. | 83/374 |
| 3,777,604 | 12/1973 | Gerber . | |
| 3,848,327 | 11/1974 | Gerber et al. . | |
| 4,205,835 | 6/1980 | Gerber | 83/451 |
| 4,312,254 | 1/1982 | Pearl . | |
| 4,322,993 | 4/1982 | Stumpf . | |
| 4,328,726 | 5/1982 | Pearl . | |
| 4,345,496 | 8/1982 | Pearl | 83/100 |
| 4,373,412 | 2/1983 | Gerber et al. . | |
| 4,391,168 | 7/1983 | Gerber et al. . | |
| 4,444,078 | 4/1984 | Pearl . | |
| 4,452,113 | 6/1984 | Pearl . | |
| 4,476,756 | 10/1984 | Pearl et al. . | |
| 4,485,712 | 12/1984 | Gerber . | |
| 4,494,433 | 1/1985 | Gerber . | |
| 4,528,878 | 7/1985 | Gerber . | |
| 4,542,672 | 9/1985 | Pearl . | |
| 4,685,363 | 8/1987 | Gerber . | |
| 4,730,526 | 3/1988 | Pearl et al. . | |
| 4,828,238 | 5/1989 | Mozieka et al. . | |
| 4,850,579 | 7/1989 | Fisher | 83/451 |
| 4,949,610 | 8/1990 | Jones et al. | 83/451 |
| 5,189,936 | 3/1993 | Gerber et al. . | |
| 5,193,423 | 3/1993 | Bakker | 83/155 |

FOREIGN PATENT DOCUMENTS

| | | | |
|---|---|---|---|
| 9111377 | 8/1991 | WIPO | 198/689.1 |

*Primary Examiner*—Maurina T. Rachuba

*Attorney, Agent, or Firm*—The Bell Seltzer Intellectual Property Group of Alston & Bird, LLP

[57] ABSTRACT

A machine and method of using same for cutting soft sheet material, such as textile fabric, which includes a cutting table having a support surface with openings distributed thereover. An endless conveyor of relatively high air permeability overlays and is movable relative to the support surface for moving sheet material. An endless micro-porous support belt having a relatively low air permeability overlays the conveyor for corresponding movement therewith. A vacuum source is connected to the cutting table and cooperates with the micro-porous support belt to retain the sheet material thereon in a relatively fixed position during transporting and cutting thereof and to retain the micro-porous support belt in engagement with the conveyor for uniform movement therewith. A cutting tool is supported on a cutting table for cutting the sheet material. The cutting tool has a washer positioned adjacent the cutting wheel to limit the penetration of the cutting wheel in the micro-porous support belt. An indexing device is provided to cooperate with the cutting tool for locating the position of the sheet material prior to cutting thereof.

8 Claims, 3 Drawing Sheets

HIGH SPEED SHEET MATERIAL CUTTER AND METHOD OF USING SAME

FIELD OF THE INVENTION

This invention relates generally to a machine for cutting sheet material, and a method of using same, and more particularly to a cutting machine for high speed cutting of single and low plies of the sheet material such as fabrics and a method of using same.

BACKGROUND OF THE INVENTION

The advent of "just in time" manufacturing has changed the focus of cutting technology for sheet material, generating a need for machines which are capable of automatically cutting only one or a few plies of soft sheet materials, such as textile fabrics, paper, cardboard and soft metals, at a time.

One method available for cutting a single ply of sheet material uses a freely rotatable cutting wheel rotatably mounted on a non-powered bearing axle. As shown in U.S. Pat. Nos. 4,373,412 and 4,391,168 to Gerber et al., pressure is applied to the cutting blade which forces it against the sheet material. As the wheel moves in a forward direction it rotates on its axle and cuts the sheet material.

A problem with using such cutting wheels is that as the cutting wheel is translated along the top of the fabric, a wrinkle or a wave will typically be generated ahead of the cutting wheel. This wrinkling of the fabric often results in an imprecise cut. One attempt to solve the problem of wrinkling is disclosed in U.S. Pat. Nos. 4,373,412 and 4,391,168 to Gerber et al. The disclosed cutting wheel uses a lower surface of a stripper, attached to the cutting wheel in confronting relationship with the sheet material to prevent any significant lifting of the sheet material. A pressure sensitive adhesive is also placed between the sheet material and the support surface to retain the sheet material thereon. Alternatively, the sheet material is held down by freezing it to the support surface by means of a settable liquid such as water.

Rather than using an adhesive, it is well known in the art to use a vacuum, at least on a portion of the cutting table, to hold the sheet material down during cutting. Examples of such use may be seen in U.S. Pat. Nos. 4,828,238, 4,528,878, 4,494,433, and 4,312,254. Typically air passageways are provided in the cutting table to allow fluid communication between the vacuum and the support surface. An example of these passageways is disclosed in U.S. Pat. Nos. 4,444,078, 3,848,327, 3,777,604 and 3,682,750. A problem with such passageways in the supporting surface is that the suction created by the vacuum may cause the sheet material to be partially drawn into the passageways, causing wrinkles and an imprecise cut. To prevent the sheet material from being drawn into the passageways, U.S. Pat. No. 4,444,078, introduces the use of a poppet valve overlying each of the passageways. Unfortunately, because the valves are biased in the open or up position, the sheet material still wrinkles, it just does so in the opposite direction.

To be effective, the existing cutting process requires the cutting wheel to pass completely through the sheet material being cut and extend some distance downwardly into the material of the supporting surface. Consequently, the ability to control the penetration of the cutting wheel into the supporting surface i.e., the depth of cut made by the cutting wheel, is important to maintaining the longevity of both the cutting wheel and the supporting surface as well as obtaining a clean cut of the sheet material.

One method of controlling the depth of penetration of the cutting wheel, to obtain a clean cut, is set forth in U.S. Pat. No. 4,391,168 to Gerber et al. The Gerber et al. patent discloses a pneumatic or hydraulic cylinder used to lower the cutting wheel into cutting engagement with the sheet material and produce a downward force sufficient to ensure that the peripheral cutting edge of the cutting wheel slightly scores the metal support surface as the wheel is in cutting engagement with the sheet material. The downward force is controlled by a cylinder which limits the depth of cut to ensure that scoring of the support surface by the cutting wheel does not rapidly dull the peripheral edge thereof. U.S. Pat. No. 4,444,078 discloses an alternative approach which controls the depth of cut by using a valve disposed above each of the air passageways located in the support surface. Each valve is biased in an open position to provide resistance to the cutting wheel and prevent the sheet material from being forced into the passageways by the cutting wheel, to thereby ensure a clean cut of the sheet material.

Transporting the sheet material from one end of the cutting table to the other by means of conveyors to speed up the cutting process is well known in the art. However, as may be seen in U.S. Pat. Nos. 5,189,936, 4,476,756, 4,542,672, 4,452,113, 4,322,993, 3,848,327, and 3,495,492, existing conveyor systems are used primarily with a support surface made from soft vertically oriented bristles, commonly used with reciprocating cutting blades.

The desire of cutting machine manufacturers and operators to meet the increasing demand for cutting machines which are capable of cutting only one or a few plies of limp or soft sheet material is difficult with the technology presently available. The use of currently available cutting wheels and existing hold down techniques may cause imprecise cuts due to wrinkling of the sheet material. In addition, existing cutting wheels are subjected to rapid dulling because of the methods available for controlling the depth of cut. Furthermore, while beneficial to improving the overall speed of the cutting process, existing conveyor systems are not well suited for use with more rigid support surfaces commonly used with cutting wheels.

SUMMARY OF THE INVENTION

In view of the foregoing background, it is therefore an object of the present invention to provide a machine capable of high speed cutting of single or low ply soft sheet material using a cutting wheel and a method of using same.

These and other objects, features, and advantages of the present invention are obtained by providing a machine for cutting soft sheet material, such as textile fabric, which has a cutting table having a support surface containing a plurality of openings distributed thereover. An endless conveyor of relatively high air permeability is provided which overlays and is movable relative to the support surface for moving the sheet material along at least a portion of the cutting table. An endless micro-porous support belt of relatively low air permeability is provided which overlays the conveyor belt to allow corresponding movement therewith. A vacuum source is connected to the cutting table and cooperates with the micro-porous support belt to retain the sheet material thereon in a relatively fixed position during transporting and cutting thereof. The vacuum source also retains the micro-porous support belt in engagement with the conveyor belt for substantially unitary movement therewith. A cutting tool is supported on the cutting table relative to the support surface and is movable into engagement with the sheet material for cutting same.

Preferably the micro-porous support belt is made from a sintered beaded plastic, such as polypropylene, with holes of 80 to 120 microns diameter distributed throughout the support belt. In addition, the micro-porous support belt advantageously has a thickness of approximately ⅛ of an inch and an air permeability of between 1500 to 3500 ml/min of air through a ½ inch diameter hole at a pressure of 1.2 inches of water. The use of the micro-porous support belt provides a significant benefit to the machine operator. For instance, because the micro-porous support belt is air-permeable, the vacuum connected to the cutting table can easily retain the sheet material on the micro-porous support belt during transportation and cutting and it can retain the micro-porous support belt in engagement with the conveyor for substantially uniform movement therewith. To obtain these desired uses of the micro-porous support belt, it is preferable for the vacuum to generate between 0.8 and 2 inches of water column at the support surface. The micro-porous support belt is also flexible which makes it well suited to overlay and be used with the conveyor. A preferred alternative to using a sintered polypropylene for the micro-porous support belt is to use a micro-porous paper.

The cutting tool is preferably a cutting wheel having a peripheral cutting edge. Advantageously a mounting block is provided which has a first end for receiving the cutting wheel and a second end for pivotally connecting a steering shaft for selectively pivoting the cutting wheel. Desirably a means is provided for fastening the cutting wheel to the first end of the mounting block and a means is connected to the steering shaft for selectively controlling the amount of pressure applied to the cutting wheel during cutting of the sheet material. A mounting bracket preferably surrounds at least a portion of the steering shaft and the mounting bracket for mounting them to the cutting machine. In addition, a pair of washers are ideally positioned on the fastener means. Preferably at least one of the washers is in cooperative engagement with the sheet material for limiting the depth of cut of the cutting wheel during cutting of the sheet material.

Preferably one of the washers is an annular flat washer and the other is a frusto-conical washer. Advantageously the frusto-conical washer is positioned on the fastener means opposite the annular washer so as to limit any bending of the frusto-conical washer during tightening of the cutting wheel. Desirably the cutting wheel, the frusto-conical washer and the annular flat washer have a narrow width for minimizing the wrinkling of sheet material during movement of the cutting wheel. A preferred alternative to the use of a frusto-conical washer is to use two annular flat washers positioned on opposite sides of the cutting wheel.

A further advantage of the pair of washers is that they are readily interchangeable for a different pair of washers having either a larger or smaller external diameter. By replacing the washers with a pair having a larger or smaller external diameter, allows the operator to limit the depth of cut made by the cutting blade depending upon the thickness of the material, the dullness of the cutting edge of the cutting wheel and the number of plies being cut. As a consequence of this ability to control the depth of cut, the operator can extend the life of the cutting wheel and the support belt, while maintaining the quality of the cut being made in the sheet material. Furthermore, because of the cooperation between the washers and the vacuum, the sheet material is held down on the micro-porous support belt without appreciable wrinkles or waves. As a result of the sheet material being held flat on the micro-porous support belt during cutting, the cutting wheel is able to make a precise cut in the sheet material.

The preferred method for cutting soft sheet material, such as textile fabric, includes transporting the sheet material along a cutting table and across a source of suction on an endless conveyor of relatively high air permeability, while retaining the sheet material in a relatively fixed position during transporting and cutting thereof. Positioning an endless micro-porous support belt of relatively low air permeability in overlaying relation to the conveyor, while it is under the influence of the suction created by the vacuum so as to hold the sheet material received on the support belt for substantially uniform movement therewith. The suction created by the vacuum also results in a substantially uniform movement of the micro-porous support belt and the conveyor.

DETAILED DESCRIPTION OF THE PREFERRED EMBODIMENTS

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
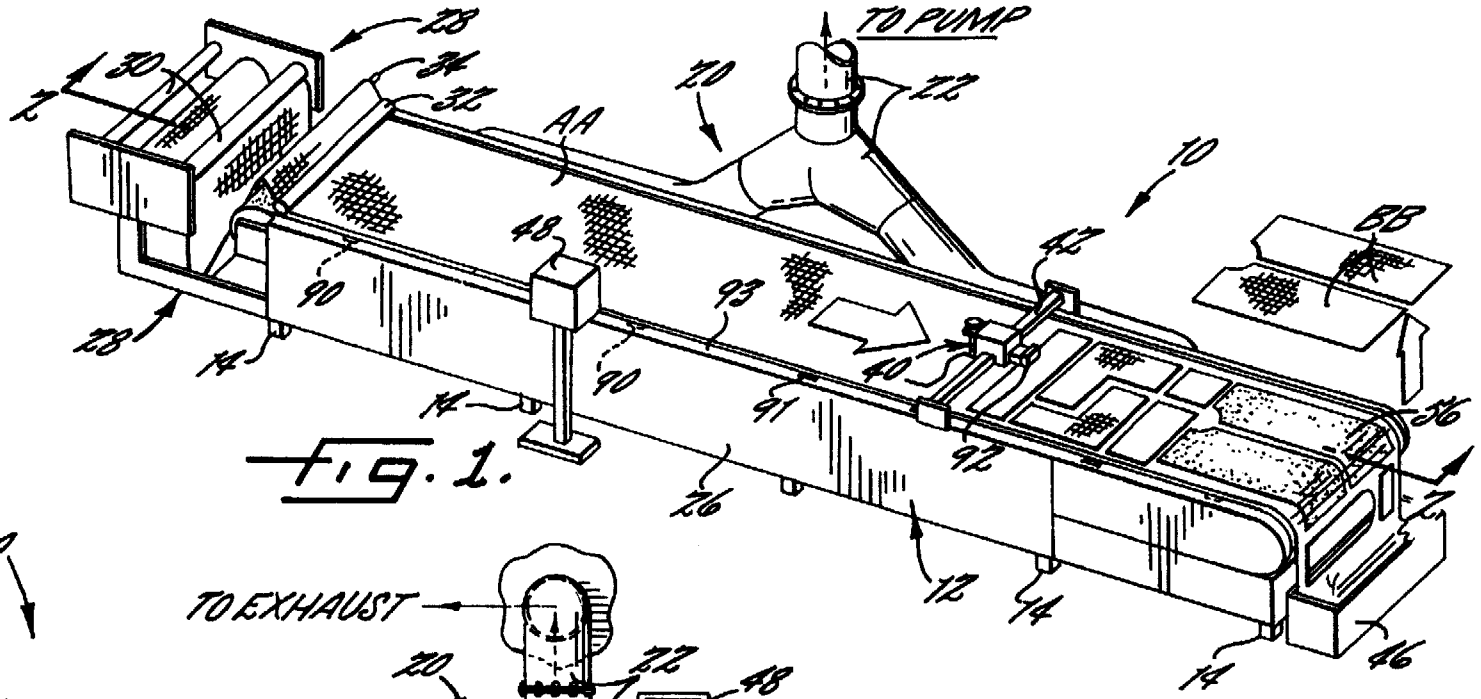
FIG. 1 is a side view in perspective of the cutting machine in accordance with the present invention.
Figure 2:
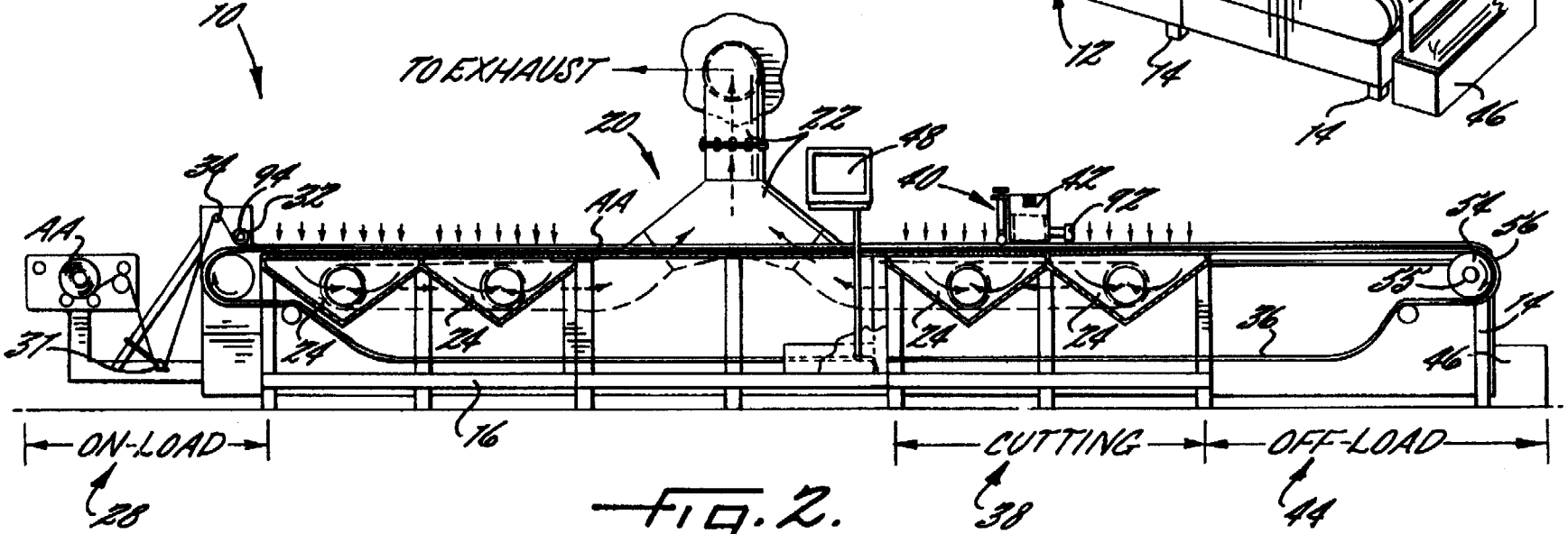
FIG. 2 is a side view in partial cross section of the cutting machine showing the vacuum and conveyor systems.
Figure 3:
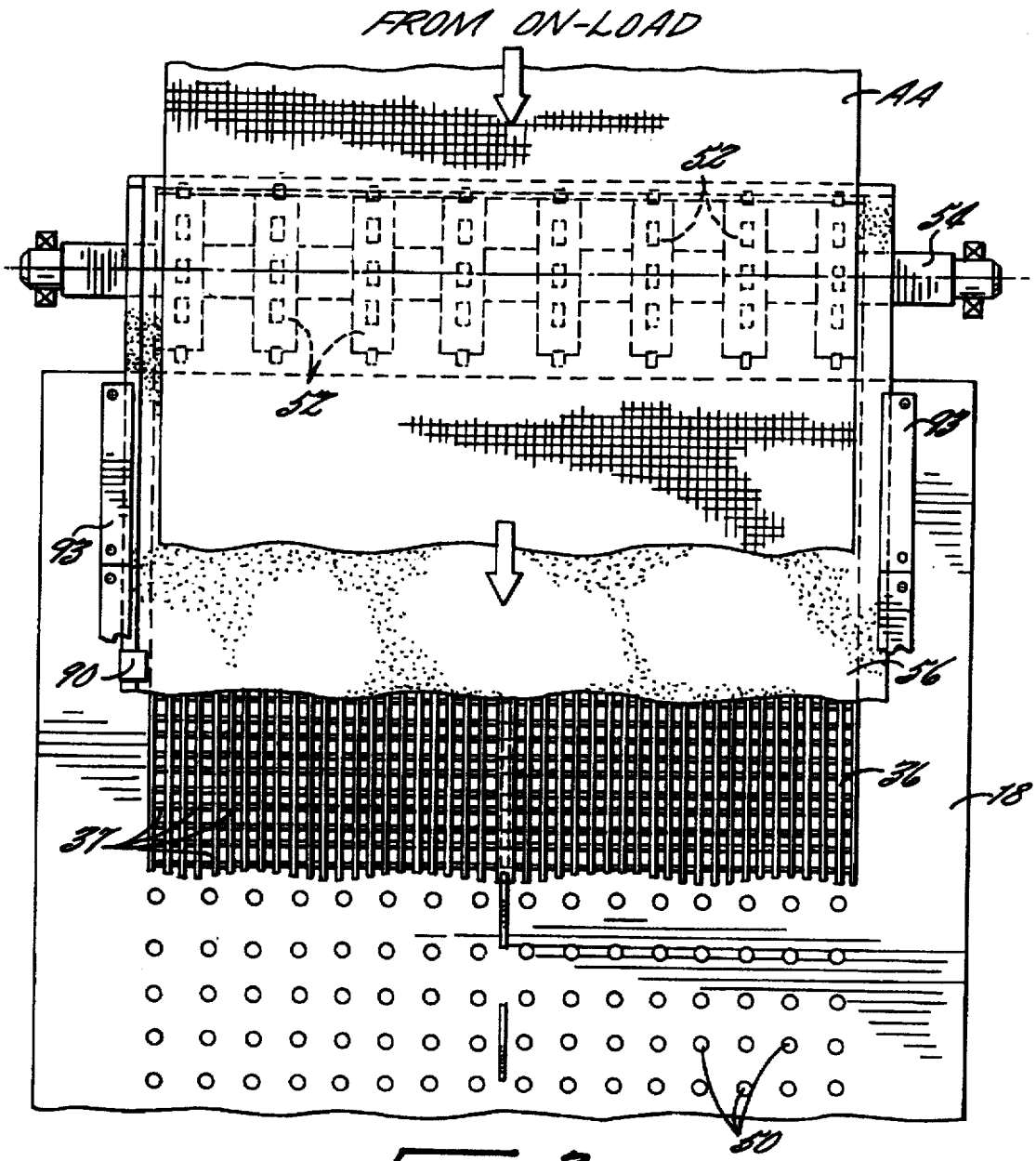
FIG. 3 is a top plan view partially cut away showing the relationship of the various components and the drive mechanism for driving the conveyor.
Figure 4:
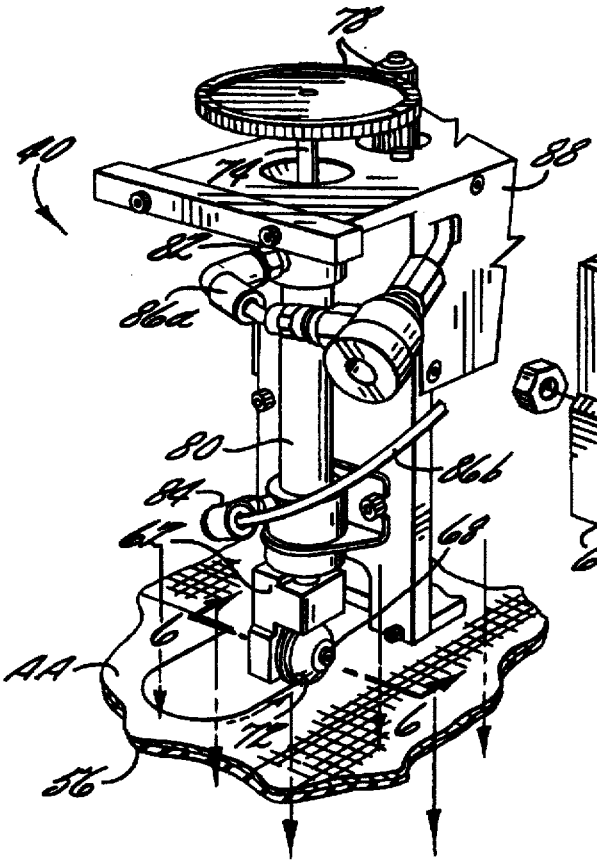
FIG. 4 is a detailed perspective view of the cutting tool shown in FIG. 1.
Figure 5:
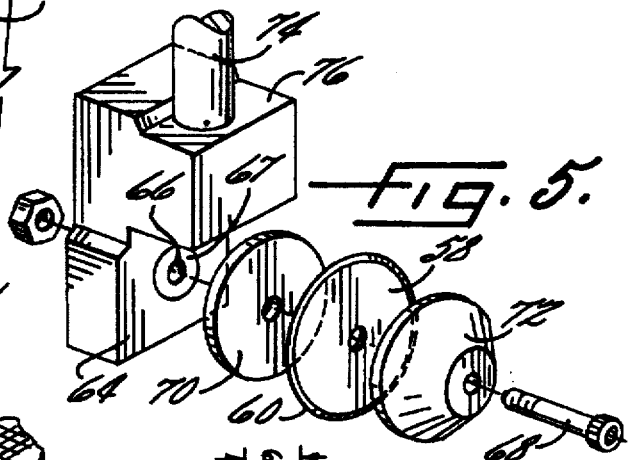
FIG. 5 is an exploded view of the working end of the cutting tool shown in FIG. 4.

Referring to the drawings, the preferred embodiment of the present invention is shown in FIGS. 1 through 8. As illustrated in FIGS. 1–3, a cutting machine, generally indicated as 10, includes a cutting table, generally indicated as 12, formed from a plurality of legs 14 and cross members 16, which support a generally rectangular support surface 18. A vacuum, generally indicated as 20, is connected to the cutting table 12, through a series of pipes 22, to create a pair of vacuum chambers or plenums 24 along selected portions of the cutting table. It is understood by those skilled in the art that a single vacuum plenum may extend the entire length of the cutting table or a number of smaller vacuum plenums may be used at desired locations on the cutting table in accordance with the present invention.

The cutting table 12, as shown in FIGS. 1–3, may be positioned adjacent a wall to minimize the length of pipes 22 required to attach the vacuum plenums 24 of the cutting table to a pump (not shown) for creating the vacuum 20. The best results have been achieved with a pump which generates a suction or air pressure at the support surface 18 of between 3 to 8 inches of water column.

The cutting machine 10 includes an on-load area, generally indicated as 28, for receiving a roll of sheet material AA to be cut. A series of on-load rollers 30 cooperate with each other to feed the sheet material AA passed a tensioning roller 31, a straightening rod 34, and a conveyor roller 32 located on the cutting table 12. The cutting machine 10 uses an endless conveyor 36, described in detail below, to move the sheet material AA from the on-load area 28 to a cutting area 38. At the cutting area 38, a cutting tool, generally indicated as 40, attached to a gantry 42, cuts the sheet material AA according to the desired pattern. The conveyor 36 then transports the sheet material AA and its cut pieces BB to an off-load area 44 where the cut pieces are accumulated in a collection container 46. A computer 48 is positioned adjacent the cutting table 12 for use by the operator to control at least the transporting and cutting operations of the cutting machine 10.

Referring to FIGS. 2 and 3, it may be seen that the support surface 18 of the cutting table 12 has a plurality of openings 50 which are distributed throughout its surface 18. These openings 50 are sized and spaced in the support surface 18 so as to put the support surface in fluid communication with the vacuum plenums 24, formed in the underside of the cutting table 12, and so that the effect of the vacuum plenums is distributed across the entire support surface. The best results have been achieved by having openings 50 which are ¾ inch diameter on 6 inch centers.

Overlaying the support surface 18, is the endless conveyor 36. In the embodiment shown, the conveyor 36 has a plurality of interconnected plastic links 37 which provide the conveyor with a relatively high air permeability allowing it to be in fluid communication with the vacuum plenums 24. In addition, the link construction of the conveyor 36 also allows it to cooperate with a series of drive sprockets 52 on a rotatable drive shaft 54 for selectively advancing the conveyor along the support surface 18. The drive shaft 54 is driven by a motor (not shown) which is connected by an encoder 55 to the computer 48. By using the computer 48 to drive the motor, the operator is able to index the conveyor a predetermined amount. The plastic used in forming the conveyor 36 has a relatively high co-efficient of expansion. Therefore, even though the conveyor 36 is driven by the drive sprockets 52 on the drive shaft 54, the actual distance the conveyor moves per sprocket revolution changes as the plastic links 37 change with temperature.

To ensure that the sheet material AA is cut at the desired location, contrasting or reflective tabs 90, shown in FIGS. 1–3, are placed along the edge of a micro-porous support belt 56. When the conveyor is to be indexed, a detector unit 92 attached to the gantry 42 moves slowly toward one of the reflective tabs 90, which are periodically exposed by notches 91 located in a metal retaining strip 93. Once the tab 90 is found, the location of the tab is recorded in the coordinate system of the gantry 42. The gantry 42 is then indexed away from the tab 90 an amount equal to the desired index distance of the micro-porous support belt 56. The conveyor 36 is then advanced until the detector unit 92 locates the identified reflective tab 90. The conveyor 36 is then turned off. The edge of the tab 90 is then located by the detector unit 92 and the location is recorded. The two recorded locations of the tab, i.e., before and after the movement of the micro-porous support belt 58, are calculated to provide the location of the micro-porous support belt and the exact indexed distance. Because the sheet material AA is retained on the micro-porous support belt 56 in a relatively fixed position by the vacuum 20, locating the micro-porous support belt locates the sheet material for precise cutting thereof.

An alternative method of indexing the conveyor 36 is to use the conveyor roller 32, which is placed on top of the conveyor 36 along with a pulse encoder 94 attached concentrically thereto. As the conveyor 36 and the sheet material AA is advanced toward the cutting tool 40, a pulse is generated by the encoder 94 corresponding to the distance that the sheet material AA advanced. From the number of pulses generated, it is possible to calculate the location of the micro-porous support belt 56 and the sheet material AA. In this embodiment, the conveyor roller 32 has an external diameter of approximately 2½ inches which is covered by a high friction material such as rubber or sandpaper (not shown) which engages the sheet material AA. The pulse encoder 94 used in this embodiment is a two-channel unit produced by Torque Systems, Inc. As the conveyor 36 and the sheet material AA advance along the cutting table 12, the rotation of the conveyor roller 32 is counted (2,000 pulses=1 revolution or 4.90625 inches) by the pulse encoder 94. This embodiment compensates not only for temperature changes of the plastic links 37 of the conveyor 36 but also compensates for any slippage between the sheet material AA and the micro-porous support belt 56 and the conveyor belt 36. It will be generally understood that either the detector unit 92 or the pulse encoder 94, but not both will be used to locate the sheet material AA.

As shown, the endless micro-porous support belt 56, made of sintered beaded plastic, such as polypropylene, overlays the endless conveyor 36. The sintered polypropylene provides the micro-porous support belt 56 with a relatively low air permeability when compared to the conveyor 36. However, the air permeability of the micro-porous support belt 56 is such that it is in fluid communication with the vacuum plenums 24 so that the suction created by the vacuum 20 holds down or retains the sheet material AA thereon in a relatively fixed position during both transportation and cutting thereof. In addition, the vacuum 20 applies sufficient suction, in the range of 0.8 to 2 inches of water column, to cause the micro-porous support belt 56 to remain in engagement with the conveyor 36 for substantially uniform movement therewith, without actual force being applied to the support belt. The 0.8 to 2 inches of water column is sufficient air pressure applied to the support surface 18 to overcome leakage of air passing through the micro-porous support belt 56. Because the vacuum 20 can generate the desired air pressure at the support surface 18, a thin non-porous film plastic film (not shown) does not have to be placed on top of the sheet material AA. To obtain this desired amount of air pressure requires a volume of approximately 100 cubic feet per minute of air to be extracted from the vacuum plenums 24 for each square foot of conveyor space. Alternatively, the micro-porous support belt 56 may be made of a fourdrinier cellulosic web which is saturated with latex.

The cutting tool 40 used to cut the sheet material is clearly illustrated in FIGS. 1 and 4–8. As shown, the cutting tool 40 includes a cutting wheel 58 having a peripheral cutting edge 60 for cutting the sheet material AA. A generally L-shaped mounting block 62 has a first end 64 for receiving the cutting wheel 58. The first end 64 defines a bore 66 which has a bearing 67 positioned therein to receive a means for fastening, such as a partially threaded bolt 68 and a nut 69, the cutting wheel 58 to the mounting block 62.

Positioned on the bolt 68, on opposite sides of the cutting wheel 58, are a pair of washers, namely an annular flat washer 70 and a frusto-conical washer 72. The frusto-conical washer 72 is positioned on the bolt 68 to the outside of the cutting wheel 58 to limit any bending of the frusto-conical washer when the cutting wheel is fastened onto the bolt. It is possible to instead use two annular flat washers and obtain the same results.

In this embodiment, both the frusto-conical washer 72 and the annular flat washer 70 cooperatively engage the sheet material AA during the cutting process for limiting the penetration of the cutting wheel 58 into the micro-porous support belt 56, i.e., the depth of cut. The pair of washers 70 and 72 also limit the depth of cut of the cutting wheel 58 by having an external diameter which is approximately 30 thousandths of an inch less than the external diameter of the cutting wheel. The cutting wheel 58 can therefore penetrate no more than 30 thousandths of an inch into the micro-porous support belt 56, which prevents the micro-porous support belt from being cut up, thereby greatly extending the workable life of both the cutting wheel and the micro-porous support belt. Additional pairs of washers, having different external diameters may be selectively interchanged on the bolt 68 to vary the depth of cut, corresponding to the thickness and number of plies of sheet material AA to be cut. An acceptable alternative to the present invention is to have only one of the washers engage the sheet material. In such an embodiment, the non-engaging washer may have an external diameter smaller than the external diameter of the cutting wheel, but not so small that the difference in external diameters between the small washer and the cutting wheel is equal to or exceeds sixty percent of the thickness of the micro-porous support belt 56. Accordingly, the diameter of the smaller washer should be sufficiently large so as to prevent the cutting wheel from slicing through the micro-porous support belt 56.

Figure 8:
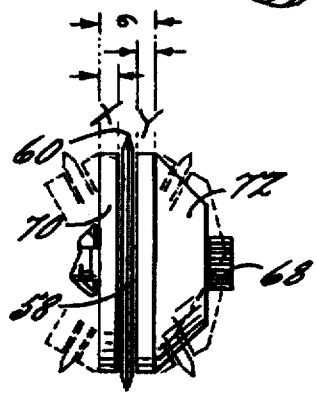
FIG. 8 is an enlarged top plan view of the cutting wheel showing the width of the cutting wheel and limiting means in a variety of positions.
Figure 6:
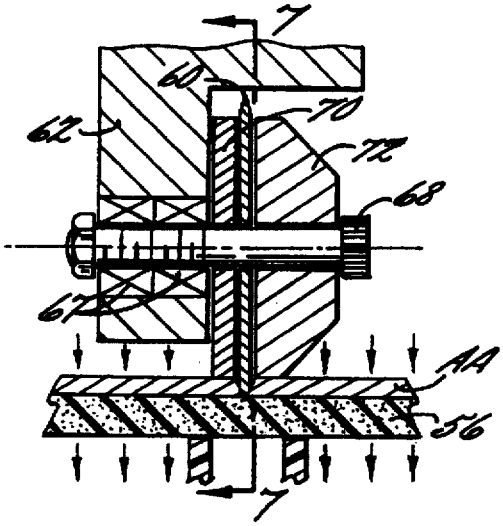
FIG. 6 is a cross sectional view of the cutting tool, the sheet material and the micro-porous support belt during the cutting operation taken along line 6—6 of FIG. 4.
Figure 7:
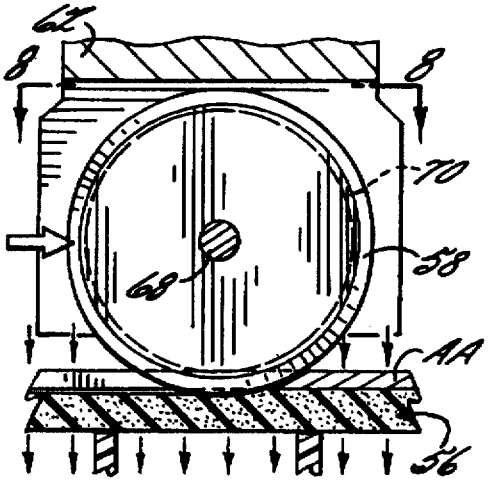
FIG. 7 is a cross sectional view taken along line 7—7 of FIG. 6.

As shown in FIG. 8 the overall width $\sigma$ of the cutting wheel 58 remains narrow because of the narrow width x of the annular flat washer 70 and the narrow width y created by the angled profile of the frusto-conical washer 72. This narrow overall width $\sigma$ of the cutting wheel 58 and the washers 70 and 72, in cooperation with the amount of air pressure generated by the vacuum 20 also helps to minimize or prevent the creation of any appreciable wrinkling or waving of the sheet material AA during cutting by holding it tight against the support surface 18.

A steering shaft 74 is pivotally connected to a second end 76 of the mounting block 62. The steering shaft 74 cooperates with a series of gears, collectively referred to as 78, for selectively pivoting the cutting wheel 58 to allow it to move in both a linear and arcuate direction. A cylindrical housing 80 houses a central portion of the steering shaft 74. The cylindrical housing 80 has a fluid inlet 82 and a fluid outlet 84, formed therein. Both the fluid inlet 8 2 and the fluid outlet 84 have a fluid line **86*a* and 86*b***, respectively connected thereto.

The cylindrical housing 80 operates as a hydraulic cylinder wherein the steering shaft 74 attaches to the piston, longitudinally movable relative to the housing, for selectively controlling the amount of pressure which is applied to the cutting wheel 58 during cutting of the sheet material AA. Therefore, as the peripheral cutting edge 60 becomes dull, the pressure may be increased to maintain the cutting action of the cutting wheel 58. It is to be understood that fluids other than hydraulic fluid may be used to operate the cylindrical housing 80. A mounting bracket 88, at least partially surrounds and retains the steering shaft 74 for mounting the cutting tool 40 onto the cutting machine 10.

Many modifications and other embodiments of the invention will come to mind in one skilled in the art to which this invention pertains having the benefit of the teachings presented in the foregoing descriptions and the associated drawings. Therefore, it is to be understood that the invention is not to be limited to the specific embodiments disclosed. Although specific terms are employed, they are used in a generic and descriptive sense only and not for purposes of limitation, and that modifications and embodiments are intended to be included within the scope of the appended claims.

That which is claimed:

1. A machine for cutting soft sheet material such as textile fabric comprising:

a cutting table having a support surface containing a plurality of openings distributed thereover;

a vacuum source connected to said cutting table and in communication with the openings in said cutting table;

an endless conveyor having a predetermined air permeability overlaying and movable relative to said support surface for moving the sheet material;

a cutting tool supported on said cutting table above said endless conveyor, said cutting tool having a downwardly directed sharp edge for engagement with the sheet material; and an endless support belt overlying said conveyor for supporting the sheet material below said cutting tool, said support belt having a predetermined air permeability lower than the air permeability of said conveyor for being retained on said conveyor for movement therewith and for retaining the sheet material in a relatively fixed position on said support belt during transporting and cutting of the sheet material, said support belt further having a tough engagement surface against which the sharp edge of said cutting tool is engaged without causing substantial downward deformation of said support belt so that the sheet material is cut by the sharp edge of said cutting tool.

2. A machine as set forth in claim 1 wherein said cutting tool further comprises a cutting wheel and a washer positioned adjacent said cutting wheel for engaging the sheet material during cutting thereof against said support belt and for limiting penetration of said cutting wheel into said support belt.

3. A machine as set forth in claim 1 wherein said support belt comprises a micro-porous sintered beaded plastic.

4. A machine as set forth in claim 3 wherein said sintered beaded plastic comprises polypropylene.

5. A machine as set forth in claim 3 wherein said micro-porous support belt has holes ranging between 80 to 120 microns in diameter distributed throughout.

6. A machine as set forth in claim 5 wherein said micro-porous support belt has an air permeability of between 1500 and 3500 ml/min of air through a ½" diameter hole at a pressure of 1.2" of water.

7. A machine as set forth in claim 1 wherein said support belt comprises a fourdrinier cellulosic web saturated with latex.

8. A machine as set forth in claim 1 wherein said micro-porous support belt has a thickness of between 1/16 inch and ½ inch.

* * * * *

UNITED STATES PATENT AND TRADEMARK OFFICE

CERTIFICATE OF CORRECTION

PATENT NO. : 5,699,707

DATED : December 23, 1997

INVENTOR(S) : Robert L. Campbell, Jr.

It is certified that error appears in the above-identified patent and that said Letters Patent is hereby corrected as shown below:

Col. 7, l. 53, "8 2" should be --82--.

Signed and Sealed this

Twenty-sixth Day of May, 1998

Bruce Lehman

*Attest:*

BRUCE LEHMAN

*Attesting Officer*

*Commissioner of Patents and Trademarks*